US006727778B2

(12) United States Patent
Kudrle et al.

(10) Patent No.: US 6,727,778 B2
(45) Date of Patent: Apr. 27, 2004

(54) TRANSMISSION LINE STRUCTURES FOR USE AS PHASE SHIFTERS AND SWITCHES

(75) Inventors: Thomas D. Kudrle, Cambridge, MA (US); Hercules P. Neves, Ithaca, NY (US); Damien C. Rodger, Chelmsford, MA (US); Noel C. MacDonald, Santa Barbara, CA (US)

(73) Assignee: Cornell Research Foundation, Inc., Ithaca, NY (US)

( * ) Notice: Subject to any disclaimer, the term of this patent is extended or adjusted under 35 U.S.C. 154(b) by 0 days.

(21) Appl. No.: 09/874,365

(22) Filed: Jun. 6, 2001

(65) Prior Publication Data

US 2002/0101300 A1 Aug. 1, 2002

Related U.S. Application Data

(60) Provisional application No. 60/209,596, filed on Jun. 6, 2000.

(51) Int. Cl.[7] ..... H01P 5/04; H01P 1/10; H01P 1/18

(52) U.S. Cl. ..... 333/33; 333/262; 333/161

(58) Field of Search ..... 333/262, 258, 333/200, 105, 193, 156, 161, 33; 200/181

(56) References Cited

U.S. PATENT DOCUMENTS 5,025,346 A * 6/1991 Tang et al. ..... 361/283
5,839,062 A * 11/1998 Nguyen et al. ..... 455/323
5,914,553 A 6/1999 Adams et al.
6,000,280 A 12/1999 Miller
6,020,564 A * 2/2000 Wang et al. ..... 200/181
6,180,428 B1 * 1/2001 Peeters et al. ..... 438/22
6,218,911 B1 * 4/2001 Kong et al. ..... 333/262 X
6,265,806 B1 * 7/2001 Suzuki ..... 310/309
6,307,169 B1 * 10/2001 Sun et al. ..... 333/105 X
2001/0038254 A1 * 11/2001 Dhuler ..... 310/307

OTHER PUBLICATIONS

A. A. Ayon, "Tunable, Micromachined Parallel–Plate Transmission Lines," IEEE, (1995).

* cited by examiner

*Primary Examiner*—Benny Lee
(74) *Attorney, Agent, or Firm*—Jones, Tullar & Cooper PC

(57) ABSTRACT

Suspended single crystal silicon (SCS) beams coated with metal form transmission lines that are used in MEMs type microactuated phase shifters and switches. The characteristic impedance of any section of the transmission lines is a function of the beam spacing in that section. Microactuators, such as comb-drive actuators, are connected to the beams to vary this spacing in a controllable manner. A continuos phase shifter is formed that consists of two tunable capacitance sections connected by a matching section that reduces reflections and improves compliance of the beams to reduce the energy required to move the beams.

24 Claims, 2 Drawing Sheets

TRANSMISSION LINE STRUCTURES FOR USE AS PHASE SHIFTERS AND SWITCHES

PRIORITY CLAIM UNDER 35 U.S.C. 119 (e)

This application claims the benefit, under 35 U.S.C. 119 (e), of U.S. Provisional Application No. 60/209,596, which was filed on Jun. 6, 2000. +gi

GOVERNMENT RIGHTS STATEMENT

This invention arose out of research sponsored by a United States Government Agency, DARPA, under DARPA Grant No. DAA G55-97-1-0266. The Government has certain rights in the invention.

BACKGROUND OF THE INVENTION

1. Field of the Invention

The present invention relates in general to transmission line structures that are formed from parallel suspended beams and are configured for lateral movement with respect to one another to effect implementation of a tunable phase shifter or a switch.

2. Description of the Background Art

The application of micro-electro-mechanical system (MEMS) technology to realize microwave devices has rapidly matured over the last several years. The technology has found some of its most promising applications in the fabrication of switches. MEMS offers advantages for these devices because it can combine excellent RF performance with circuit integrate ability and low power consumption. Recently MEMS technology has been applied successfully in the fabrication of another important RF device, the millimeter wave phase shifter. Researchers at the University of Michigan have fabricated a true-time delay phase shifter using surface micromachining on a quartz substrate with excellent insertion loss and phase-shift characteristics.

SUMMARY OF THE INVENTION

The present invention comprises a new type of transmission line structure that can be employed in MEMS-based phase shifters and switches, for example. The invention employs suspended transmission lines which are formed from spaced parallel electrically conductive beams that are laterally movable relative to one another using one or more microactuators. In the preferred embodiment, the beams are each formed from a single crystal silicon (SCS) core that is coated with metal, and the microactuators are comb-drive type actuators. Lateral movement of the beams by the microactuators to vary the spacing between the beams in a controllable manner enables the structure to act as a continuously variable phase shifter because the characteristic impedance of any section of the transmission line is a function of the beam spacing in that section. The same arrangement can be employed to move the beams of the transmission line into contact with one another, thereby acting as a switch.

Preferably, the transmission line includes first and second tunable capacitance sections that are separated by a third, matching section. The matching section is positioned at an angle, preferably a right angle, to the first and second tunable capacitance sections. The microactuators are connected to the beams at the corners formed between the first tunable capacitance section and the matching section and between the matching section and second tunable capacitance section so that the lateral spacing between the beams near the corners can be changed, and thereby the effective capacitance of the tunable capacitance section can also be changed. Because, for this (and other) transmission line topologies, the spacing between the lines is extremely small, the structure shows very little reflection from the discontinuities up to high frequencies. Thus, the variable capacitance sections at the corners induce variable phase shifts while the matching section functions to cancel the reflections from the first and the second elements. The unique aspects of this design for this application are that the geometry allows the matching section to maintain a constant spacing (characteristic impedance) throughout the actuation process, which simplifies both design and analysis. This results from the matching section running parallel to the actuation direction. The design also allows the beams to be bent much more easily, compared to standard fixed—fixed beams, because of the additional compliance of the bent beams that constitute the transmission lines. This means that at low voltages, the microactuators can provide a large tuning range and therefore a large phase shift. These unique qualities of the design result in a high-performance continuous microwave phase shifter on silicon, and has a number of advantages over other ways of making phase shifters: it is inherently low-cost, has low power-consumption requirements and the use of silicon as the substrate offers excellent thermal conductivity for heat sinking and enables the device to be integrated with other VLSI technology on chip.

In the switch application of the invention, the microactuators are employed to close selectively the two corner sections together completely. The matching section is then preferably chosen to reinforce the reflection from the two sections in the closed position around a certain design frequency. Moreover, the design enables full actuation of the device at relatively low voltages. This is again due to the fact that the bend in the middle of the transmission line beams makes them much more compliant.

In the fabrication of the preferred embodiment of the invention, bulk micromachining on high resistivity (p=2–3.5 kΩ-cm) silicon wafers is preferably employed. These structures are fabricated with the known SCREAM (Single Crystal Reactive Etching and Metallization) process, a low temperature bulk micromachining technology, which enables the fabrication of tall silicon beams suspended from the substrate. The large beam height, combined with a thick metallization (>1 $\mu$m) yields transmission lines with very small ohmic losses. Since air is the only dielectric between the beams, dielectric losses and dispersion are minimized.

BRIEF DESCRIPTION OF THE DRAWINGS

The features and advantages of the present invention will become apparent from the following detailed description of a number of preferred embodiments thereof, taken in conjunction with the accompanying drawings, in which.

DETAILED DESCRIPTION OF A PREFERRED EMBODIMENT

Figure 1:
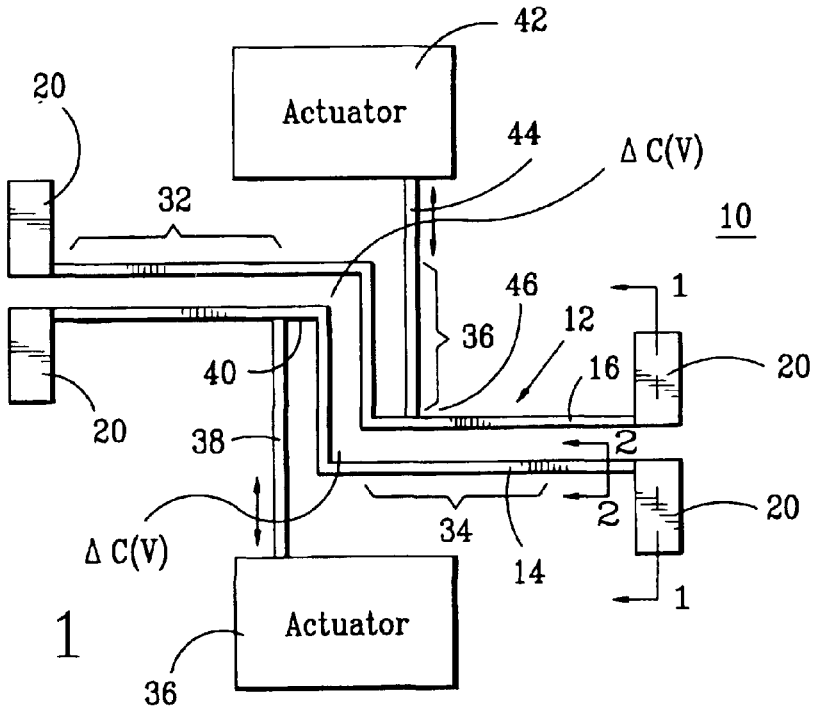
FIG. 1 is a schematic block diagram of a transmission line structure that is constructed in accordance with a preferred embodiment of the present invention.

With reference to FIG. 1, a transmission line structure 10 is illustrated that is constructed in accordance with a preferred embodiment of the present invention. The structure 10 includes a transmission line 12, which is of the ground signal (GS) parallel plate waveguide type and includes first and second parallel electrically conductive beams 14 and 16 that are spaced apart from one another by some predetermined distance. Alternatively, the transmission line 12 could be of the ground-signal-ground (GSG) type, in which case three of the conductive beams would be required, the outer two of which would be ground beams.

Figure 2:
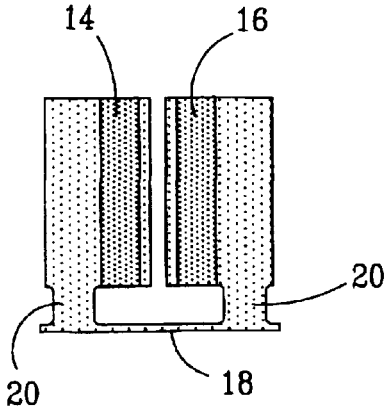
FIG. 2 is a cross sectional view of the transmission line structure of FIG. 1 taken along line 1—1 showing the suspension of a pair of transmission line beams above a substrate by means of anchors.
Figure 3:
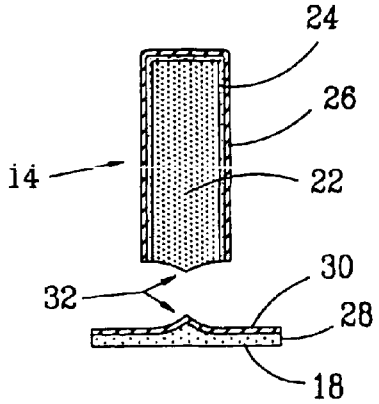
FIG. 3 is a cross sectional view of one of the transmission line beams of FIG. 1 taken along line 2—2 showing the transmission line beam suspended above the substrate.

As illustrated in FIGS. 2 and 3, each of the beams 14 and 16 is relatively tall (50–150 $\mu$m) and is suspended a predetermined distance above a single crystal silicon (SCS) substrate 18 by means of a plurality of anchors or stand-offs 20, which are also preferably made from SCS. Preferably, each of the beams 14 and 16 is formed from a high-aspect ratio SCS core 22 that is coated with a first, oxide layer 24 and a second, thick metal layer 26, which carries most of the current of the transmission line 12. The oxide layer 24 is preferably silicon dioxide, while the metal layer 26 can be any suitable low resistance conductive metal, such as copper or aluminum, for example. The metal layer 26 is electrically isolated from the silicon core 22 and the anchors 20 by the silicon dioxide layer 24. This isolation scheme allows the beams 14 and 16 to be electrically isolated from one another and from the substrate floor, which is also covered with oxide and metal layers 28 and 30, respectively, and is thus electrically shielded from the transmission line 12. This substrate shielding promises excellent switch performance at high RF frequencies where the isolation of most MEMS devices is thought to be ultimately limited by surface-mode coupling. A cusp 32 between the substrate 18 and the beam 14 results from an isotropic dry release fabrication step. Alternatively, each of the beams 14 and 16 could be formed solely of conductive metal.

The characteristic impedance of a finite height parallel plate waveguide can be found from its approximate capacitance:

$$C = \varepsilon\frac{h}{s}\left[1 + \frac{s}{\pi h}\left(1 + \ln\frac{2\pi h}{s}\right)\right]$$

where h is the height of the plates and s is the spacing between them. The characteristic impedance of the lines is then determined from:

$$Z_0 = \frac{\sqrt{\mu\varepsilon}}{C}.$$

Because the beams 14 and 16 are suspended, they can be moved with respect to one another, thereby changing the spacing between the two plates of the waveguide and its characteristic impedance.

Preferably, the beams 14 and 16 are fabricated using a modification of the SCREAM (Single Crystal Reactive Etching and Metallization) process developed at Cornell University. SCREAM is a single-mask, low temperature process that can be implemented on fully processed VLSI wafers. This process employs inductively coupled plasma (ICP) deep reactive ion etching (DRIE) technology to fabricate suspended high aspect-ratio beams. In the fabrication of millimeter wave devices, such as the present invention, the SCREAM process is modified in two significant ways. First, a long silicon etch is added after the formation of the structures which increases the distance between the bottoms of the beams and the substrate floor to approximately 100 $\mu$m. This separation improves the impedance control of the lines and reduces coupling to the actuators and anchors. The second modification is the implementation of a very thick (>1 $\mu$m versus 250 nm for conventional SCREAM) metal sputtering to reduce ohmic losses. Because the beams 14 and 16 are so tall (>50 $\mu$m), such a thick film can be deposited on them without causing significant out-of-plane strain (in-plane strain is less significant because of the symmetric coating of the beam sidewalls).

In experiments to test the performance characteristics of the resulting transmission lines, transmission lines were fabricated on both high resistivity (p=2–3.5 kΩ-cm) and standard resistivity (p=1–20 Ω-cm) wafers with beam heights ranging from 50–150 $\mu$m. The attenuation characteristics of a set of 150 $\mu$m deep lines fabricated on standard resistivity wafers exhibited less than 0.17 dB/mm attenuation over the 10–50 GHz. frequency range.

Returning to FIG. 1, the transmission line 12 includes first and second end sections 32 and 34 that are separated from one another by a matching section 36. The matching section 36 is positioned at an angle, preferably a right angle, with respect to the first and second end sections 32 and 34. A first microactuator 36 is connected by means of a first silicon beam 38 to the first transmission line beam 14 adjacent a corner 40 formed between the first end section 32 and the matching section 36. Similarly, a second microactuator 42 is connected by means of a second silicon beam 44 to the second transmission line beam 16 adjacent a corner 46 formed between the matching section 36 and the second end section 32. The purpose of the microactuators 36 and 42 is to move the beams 14 and 16 laterally with respect to one another so that the lateral spacing near the corners can be changed and the effective capacitance of the first and second end sections 32 and 34 can also be changed. The first and second end sections are both therefore referred to as tunable capacitance sections which can induce variable phase shifts in the transmission line 12.

Figure 4:
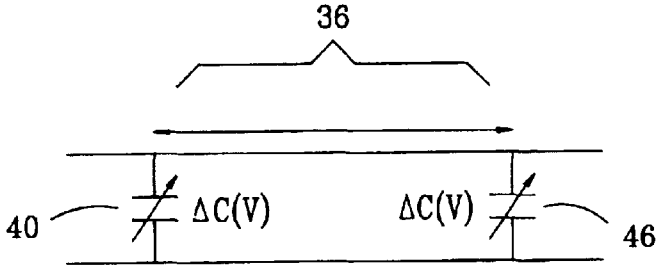
FIG. 4 is a circuit diagram of a phase shifter that can be constructed using the transmission line structure of FIG. 1.

The matching section 36 is less than $\lambda/4$ and for an example embodiment, was ~650 $\mu$m. One feature of this design is that, because this central matching section 36 runs parallel to the actuation direction of the microactuators 36 and 42, the impedance of the matching section 36 is not changed throughout the actuation process, which simplifies both design and analysis. FIG. 4 shows a circuit model of the design indicating the variable capacitance behavior of the corner sections 40 and 46 separated by the matching section 36.

The microactuators 36 and 42 are preferably electrostatic comb-drive actuators, such as those disclosed in U.S. Pat. No. 5,914,553 to Adams et al. and U.S. Pat. No. 6,000,280 to Miller et al., for example. In examining how far the actuator will move with a certain applied voltage it is necessary to look at not only the springs of the actuator but also the transmission lines to which the actuators are attached because these behave as springs as well. This is a critical factor in determining both the size of the actuators used and the thicknesses and lengths of the beams used in the transmission lines.

Figure 5:
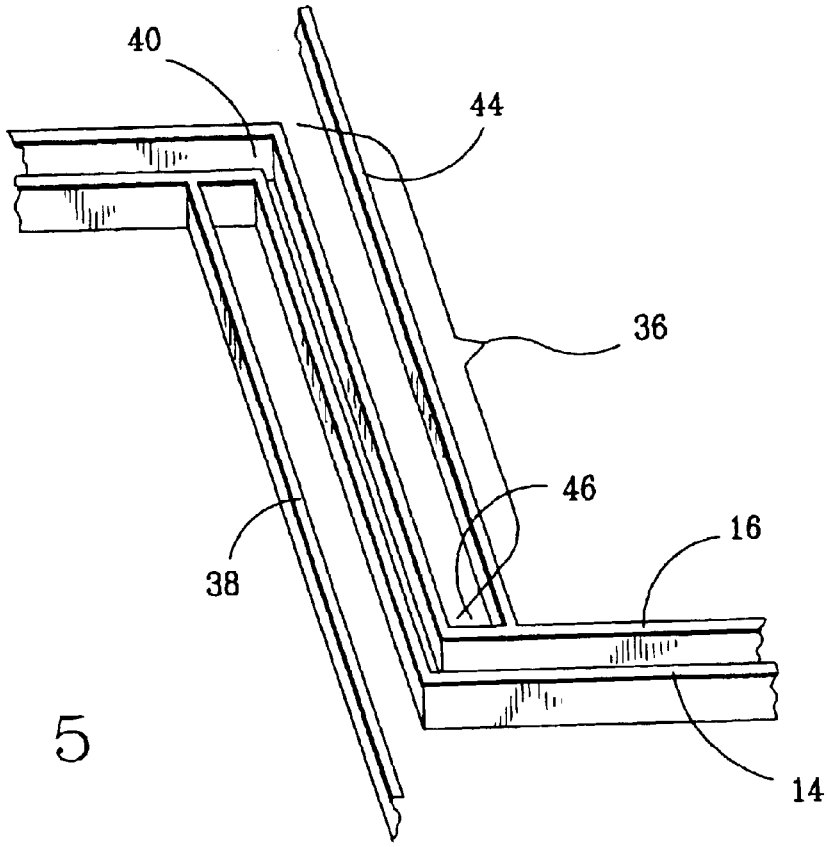
FIG. 5 is a schematic block diagram showing the transmission line structure of FIG. 1 with the transmission line beams positioned in an non-actuated state.
Figure 6:
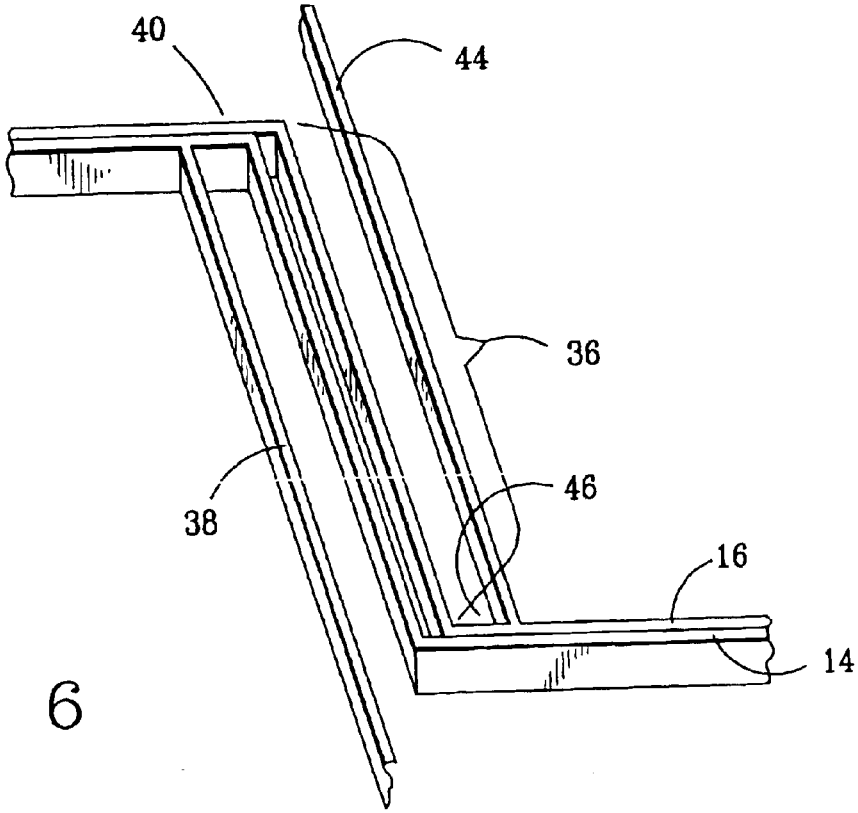
FIG. 6 is a schematic block diagram showing the transmission line structure of FIG. 1 with the transmission line beams positioned in a fully actuated state.

FIGS. 5 and 6 show the transmission line structure 10 in its non-actuated and actuated states, respectively. As illustrated, the spacing between the transmission line beams 14 and 16 is constant through the three sections and that the lines are suspended well above (>50 $\mu$m) the silicon substrate 18. This is critical to minimizing any loss incurred by the electrical connection of the actuators 36 and 42. FIG. 6 shows the device in its fully actuated state where the gaps between the beams 14 and 16 at the corners 40 and 46 have been almost completely closed. These sections are then producing large relative capacitances and large phase shifts. As the beam gaps are reduced with respect to their normal spacings, the segments start to behave as the lumped capacitors described above. The central matching section 36, as designed, has maintained a constant spacing throughout the actuation process. The structure 10 can thus be modeled as two tunable shunt capacitors separated by a length of transmission line of length 650 $\mu$m. Moving the beams 14 and 16 changes the capacitance of these lumped elements and consequently changes the phase shift induced by them, while the matching section 36 induces cancellation of the waves reflected at the first and second corners 40 and 46.

For the subject transmission line topology, the corners themselves cause very little reflection or radiation losses and can thus be used in designs without significant performance degradation. In this case, the use of the corners 40 and 46 allows the matching section 36 to have a constant characteristic impedance independent of corner displacement which simplifies design and analysis.

The design of a phase shifter using the transmission line structure 10 will now be analyzed. A short segment of transmission line ($\beta 1<\pi/4$) with a very small impedance with respect to the rest of the line can be modeled as a lumped capacitor shunting one line to the other. The approximate normalized lumped susceptance is $$b \approx \frac{Z_0}{Z_1}\beta_l$$

where $Z_0$ is the normal characteristic impedance of the line and $Z_1$ is the characteristic impedance of the segment.

The shunt capacitor causes a phase shift for transmitted waves that is proportional to this normalized susceptance.

$$\Delta\phi \approx \frac{b}{2} = \frac{Z_0}{Z_1}\left(\frac{\beta_l}{2}\right)$$

Thus by tuning the impedance (and thereby the lumped capacitance) of this section we can tune the phase shift induced by it.

Having investigated some of the main principles involved with the design of a two-element phase shifter we can now proceed to developing a specific design that is compatible with the subject invention. It is desirable that the device have a large (>22.5 degree) phase shift while having both small insertion loss and reflection. Thus, the device should be compact so that the signal does not attenuate too much just from line loss. In addition, it is desirable to develop a design that allows the beams that make up the transmission lines to bend sufficiently enough that a large phase shift can be achieved. For 50 $\mu$m tall lines with an impedance of 50 Ω, the spacing between the lines is 20 $\mu$m. It is therefore necessary to displace up to this amount in order to completely close the gap between the lines at various points.

A standard fixed—fixed beam, which normally comprises a typical transmission line system, is quite difficult to bend in the middle appreciably; the fixed—fixed beam has a very high nonlinear spring constant perpendicular to its length. This is because both of its end boundary conditions are fixed and therefore the entire spring must stretch axially for large displacements. In other words, the neutral axis, the axis that has the same length as the original un-deformed spring, disappears. If, however, a kink is inserted in the middle of the structure, the spring constant can be lowered significantly (especially for large displacements). The introduction of such a bend converts the single fixed—fixed beam into two cantilever beams with a third beam in the center. This central beam must then bend to keep its right angle connection with the two beams it is connecting. Thus, a shape with a right-angle bend in the middle promises to be much easier to displace than a simple fixed—fixed beam.

Now the issue arises of how the performance of the transmission line is itself affected by these two right-angle bends. According to the theory for an infinite parallel-plate waveguide, the right angle bend can be modeled by an π-equivalent circuit consisting of two shunt capacitors and one series inductor. The values for the series inductance and the series capacitances are $$L = \frac{\mu a^2}{w}$$

and $$\frac{C}{2} = \frac{\varepsilon w}{2}\left(1 - \frac{2}{\pi}\ln 2\right)$$

where a and w are the spacing between the two plates and the width (or in our case the height) of the plates respectively. Now because the corresponding impedances result from these elements multiplied by the frequency, the impendence values will scale inversely with wavelength. For a fixed ratio of the height of the plates to the spacing between them (constant line impedance), both the inductance and capacitance scale linearly with the spacing between the plates. For the scale of the subject structures, the series inductance is very small and the right angle discontinuity can be represented well by the two shunt capacitances whose impedances scale as the ratio of the spacing between the plates to the wavelength of the energy being transmitted. Because this ratio is very small for the subject structures (maximum of about 0.01 at the highest frequency measured −50 GHz.) the effect of the discontinuity is expected to be quite small. This is in marked opposition to the case of a rectangular waveguide, for example, where an un-mitered right-angle bend causes enormous reflections. Experiments conducted to determine the effects of the two right angle bends indeed confirmed that the resulting reflections are quite small, thus indicating that the structure can be employed in the phase shifter design without the reflections induced by it being prohibitive.

In tests performed to analyze the performance of the phase shifter constructed using the transmission line structure 10, insertion loss of the device was less than 1 dB over the whole frequency range in the unactuated state. In the actuated state, the insertion loss was about 1.6 dB at the center frequency and about 1.7–1.8 dB at the edge frequencies. The return loss for the device was less than −10 dB over the whole frequency range over all actuation states. This is important because it indicates that the reflections caused by the device will be relatively small and will not, therefore, interfere with other devices to which it is connected. It also means that several such devices could be connected together in a series to produce a larger total phase shift. In tests using different applied voltages, limitations on the bandwidth of the device were noted which further suggest that, to make a device with very large phase shift and a close approximation to true time-delay, many such devices should be cascaded together, each of which would only phase shift a relatively small amount.

To illustrate the importance of the appropriately chosen matching section, tests were conducted with two devices, one having a matching section that is optimal for the test frequency and phase-shift range (650 $\mu$m) and the other device having a matching section that is much too short (250 $\mu$m), and departs enough from the optimal length that it is expected to be very ineffective at canceling reflections. The tests confirmed that at zero applied voltage, the length of the matching section does not matter too much. In this state, the two corner sections are not departing from 50 Ω and are therefore not generating reflections that need cancellation. However, at a higher voltage and phase shift, both the insertion and return loss suffer notably when the matching section is not the appropriate length.

In the transmission line structure 10 of FIG. 1, the actuators 36 and 42 are connected to the transmission line beams 14 and 16 both electrically and physically. It was found experimentally that the connection of the actuators does produce a modest increase in the insertion loss of the device. However, it was also found that this extra loss could be reduced by lowering the ground plane beneath the transmission line 12. The loss mechanism is not understood precisely but it is believed that by lowering the ground plane, the amount of energy that is channeled out to the integrated devices is reduced.

In conclusion, the phase shifter that is implemented with the transmission line structure of the present invention is the first of its kind on silicon and yields excellent results for phase shift versus insertion loss. In the 40–48 GHz frequency range, the device had a maximum of 38 degrees phase shift with −1.6 dB loss at the center frequency, a maximum insertion loss of 1.8 dB and a maximum phase shift of 48 degrees at 48 GHz with 45 V applied bias. The transmission lines used in the phase shifter showed attenuation of about 0.2 dB/mm from 40–48 GHz. These results compare favorably with current state-of-the art devices, corresponding to the best available 3-bit digital phase shifters. The continuous nature of the phase shifter is a significant advantage for arrays with large directivity where very little phase shift error can be tolerated. In order to meet such small-error requirements with a digital phase shifter, a large number of switches would be required, raising the insertion loss significantly.

The number of commercial applications for the invention is great and includes the integration with any device requiring a high-performance phase shifter. Because the device is fabricated on silicon it can also be made with built-in control electronics. The continuous nature of the device makes it particularly well suited for applications involving high-directivity antennas (where the phase error of digital phase shifters is prohibitive). Any device that would require a high-performance switch (a very broad category of devices) could also benefit from the use of the design as the devices would operate at lower voltages and have higher performance.

Although the invention has been disclosed in terms of a number of preferred embodiment, it will be understood that variations and modifications could be made thereto without departing from the scope of the invention as defined in the following claims.

We claim:

1. A transmission line structure comprising:

a substrate;

a transmission line suspended above said substrate, said transmission line including first and second parallel end sections and a matching section disposed at an angle between said first and second end sections, said transmission line being comprised of first and second parallel conductive beams each comprised of single crystal silicon having a first insulating layer and a second conductive metal layer disposed thereon; each of said conductive beams being suspended above said substrate, having first and second fixed ends that are positioned to space said beams apart from one another in said first and second end sections of said transmission line by a first predetermined distance, and having first and second bends therein defining first and second ends, respectively, of said matching section of said transmission line; and an actuator for bending said first conductive beam toward said second conductive beam in said first and second end sections to change said first predetermined distance between said beams and thereby alter the electrical characteristics of said transmission line.

2. The transmission line structure of claim 1, wherein said matching section is disposed at a right angle relative to said first and second end sections and said first and second conductive beams are spaced from one another in said matching section by a second predetermined distance that is maintained constant.

3. The transmission line structure of claim 1, wherein said first and second ends of said conductive beams are fixed to a corresponding one of a plurality of anchors disposed on said substrate.

4. The transmission line structure of claim 1, wherein said actuator is a microactuator.

5. The transmission line structure of claim 4, wherein said microactuator is a comb-drive actuator.

6. The transmission line structure of claim 1, wherein a second actuator is provided for bending said second beam toward said first beam.

7. The transmission line structure of claim 1, wherein said first and second beams in said first and second end sections are bendable by said actuator into engagement with one another, whereby, said transmission line acts as an electrical switch.

8. The transmission line structure of claim 1, wherein said transmission line comprises an adjustable phase shifter in which said first and second end sections of said transmission line comprise first and second capacitance tuning sections of said phase shifter whose capacitance is adjustable by altering the distance between said first and second beams.

9. A transmission line structure comprising:

a substrate;

a transmission line suspended above said substrate, said transmission line including first and second parallel end sections and a matching section disposed at a ninety degree angle between said first and second end sections, said transmission line being comprised of first and second parallel conductive beams each comprised of single crystal silicon having a first insulating layer and a second conductive metal layer disposed thereon; each of said conductive beams being suspended above said substrate, having first and second fixed ends that are positioned to space said beams apart from one another in said first and second end sections of said transmission line by a first predetermined distance and having first and second ninety degree opposite angled bends therein defining first and second ends, respectively, of said matching section of said transmission line; and a first actuator for bending said first beam toward said second beam and a second actuator for bending said second beam toward said first beam to change said first predetermined distance between said beams in said first and second end sections and thereby alter the electrical characteristics of said transmission line, while maintaining said second predetermined distance between said beams in said matching section constant.

10. The transmission line structure of claim 9, wherein said transmission line comprises an adjustable phase shifter in which said first and second end sections of said transmission line comprise first and second capacitance tuning sections of said phase shifter whose capacitance is adjustable by altering the distance between said first and second beams.

11. The transmission line structure of claim 9, wherein said first and second ends of said conductive beams are fixed to a corresponding one of a plurality of anchors disposed on said substrate.

12. The transmission line structure of claim 9, wherein said first and second actuators are each a microactuator.

13. The transmission line structure of claim 12, wherein each said microactuator is a comb-drive actuator.

14. The transmission line structure of claim 9, wherein said first and second beams in said first and second end sections are bendable by said first and second actuators into engagement with one another, whereby, said transmission line acts as an electrical switch.

15. A adjustable phase shifter structure comprising:

a substrate;

a transmission line suspended above said substrate, said transmission line including first and second parallel, capacitance tuning end sections and a matching section disposed at an angle between said first and second end sections, said transmission line being comprised of first and second parallel conductive beams suspended above said substrate, each of said conductive beams having first and second fixed ends that are positioned to space said beams apart from one another in said first and second end sections of said transmission line by a first predetermined distance, each of said beams also having first and second bends therein defining first and second ends, respectively, of said matching section of said transmission line; and an actuator for bending said first conductive beam toward said second conductive beam in said first and second capacitance tuning end sections to change said first predetermined distance between said beams and thereby alter the capacitance of said phase shifter structure.

16. The phase shifter structure of claim 15, wherein a second actuator is provided for bending said second beam toward said first beam.

17. The phase shifter structure of claim 15, wherein said matching section is disposed at a right angle relative to said first and second end sections and said first and second conductive beams are spaced from one another in said matching section by a second predetermined distance that is maintained constant.

18. The phase shifter structure of claim 15, wherein said first and second ends of said conductive beams are fixed to a corresponding one of a plurality of anchors disposed on said substrate.

19. The phase shifter structure of claim 15, wherein said actuator is a microactuator.

20. The phase shifter structure of claim 19, wherein said microactuator is a comb-drive actuator.

21. A phase shifter structure comprising:

a substrate;

a transmission line suspended above said substrate, said transmission line including first and second parallel, capacitance tuning end sections and a matching section disposed at a ninety degree angle between said first and second end sections, said transmission line being formed of first and second parallel conductive beams suspended above said substrate, each of said conductive beams having first and second fixed ends that are positioned to space said beams apart from one another in said first and second end sections of said transmission line by a first predetermined distance, each of said beams also having first and second ninety degree opposite angled bends therein defining first and second ends, respectively, of said matching section of said transmission line; and a first actuator for bending said first beam toward said second beam and a second actuator for bending said second beam toward said first beam to change said first predetermined distance between said beams in said first and second capacitance tuning end sections and thereby alter the capacitance of said phase shifter structure, while maintaining said second predetermined distance between said beams in said matching section constant.

22. The phase shifter structure of claim 21, wherein said first and second ends of said conductive beams are fixed to a corresponding one of a plurality of anchors disposed on said substrate.

23. The phase shifter structure of claim 21, wherein said first and second actuators are each a microactuator.

24. The phase shifter structure of claim 23, wherein each said microactuator is a comb-drive actuator.

* * * * *